US008496019B2

(12) United States Patent
Zhou

(10) Patent No.: US 8,496,019 B2
(45) Date of Patent: Jul. 30, 2013

(54) TENT

(75) Inventor: Nanqing Zhou, Xiamen (CN)

(73) Assignee: Q-Yield Outdoor Gear Ltd., Xiamen, Fujian (CN)

( * ) Notice: Subject to any disclaimer, the term of this patent is extended or adjusted under 35 U.S.C. 154(b) by 0 days.

(21) Appl. No.: 13/575,582

(22) PCT Filed: Feb. 5, 2010

(86) PCT No.: PCT/CN2010/070549

§ 371 (c)(1),
(2), (4) Date: Jul. 26, 2012

(87) PCT Pub. No.: WO2011/094948

PCT Pub. Date: Aug. 11, 2011

(65) Prior Publication Data

US 2012/0291831 A1 Nov. 22, 2012

(51) Int. Cl.
*E04H 15/48* (2006.01)

(52) U.S. Cl.
USPC ..... 135/135; 135/147; 135/98; 52/83; 52/646

(58) Field of Classification Search
USPC ..... 135/131, 135, 144–147, 152, 156, 135/120.3, 98; 403/170–171, 217–219; 52/83, 52/81.1, 646, 645.9
See application file for complete search history.

(56) References Cited

U.S. PATENT DOCUMENTS

| | | | | |
|---|---|---|---|---|
| 4,750,509 | A * | 6/1988 | Kim | 135/135 |
| 4,966,178 | A * | 10/1990 | Eichhorn | 135/123 |
| 6,776,179 | B1 * | 8/2004 | Chen | 135/147 |
| 7,341,071 | B2 * | 3/2008 | Lee | 135/128 |
| 7,607,447 | B1 * | 10/2009 | Han | 135/135 |
| 7,861,736 | B2 * | 1/2011 | Choi | 135/143 |
| 7,896,016 | B2 * | 3/2011 | Shi | 135/147 |
| 8,047,218 | B1 * | 11/2011 | Shin | 135/135 |
| 8,069,872 | B2 * | 12/2011 | Bae | 135/147 |
| 2005/0224107 | A1 * | 10/2005 | Yang | 135/135 |
| 2006/0289048 | A1 * | 12/2006 | Choi | 135/135 |

* cited by examiner

*Primary Examiner* — Winnie Yip

(57) ABSTRACT

A tent includes a tent cloth and a tent frame to support the tent cloth. The tent frame comprises a top module and a plurality of supporting poles which are radially pivoted to the top module. The top module includes a modular main body, a top cap and a quick-pitch assembly. The modular main body includes a plurality of pivot sockets which are integrally formed with the modular main body. Each pivot socket is pivotally connected with a connector. The connector is further connected to the respective supporting pole. The connector has a top engaging portion at a pivot end thereof to mate with the quick-pitch assembly. The top cap is coupled to the modular main body to form a middle space. The quick-pitch assembly is located in the middle space and able to move up and down.

7 Claims, 8 Drawing Sheets

TENT

BACKGROUND OF THE INVENTION

1. Field of the Invention

The present invention relates to a tent.

2. Description of the Prior Art

As shown in FIG. 1, a conventional tent comprises a tent cloth and a tent frame to support the tent cloth. The tent frame comprises a top module and a plurality of supporting poles which are radially pivoted to the top module. Each supporting pole is composed of a plurality of poles which are pivotally connected through a joint. The tent cloth is fixed to the tent frame through a plurality of fixing sleeves sewn on its edge. The tent cloth is unfolded along with the tent frame. When the tent is folded as indicated by the arrow of FIG. 1, the top module is pushed downward to bring the upper poles to fold downward. During folding, the tent cloth may be torn at the fixing sleeves because the pull force is too great. FIG. 2 shows the folded state of the tent.

In order to overcome the aforesaid shortcoming, the edge of the tent cloth is provided with an elastic strap so that an elastic space is defined between the poles and the tent cloth to prevent the tent cloth from being torn. The tent is an outdoor appliance, which is exposed to the sun and rain. After a period of time, the elastic strap may be slack or torn off to influence the use of the tent. Accordingly, the inventor of the present invention has devoted himself based on his many years of practical experiences to solve these problems.

SUMMARY OF THE INVENTION

The primary object of the present invention is to provide a tent. Through a top module, the tent can be folded and unfolded and the tent cloth won't be torn at the fixing sleeve.

In order to achieve the aforesaid object, the tent of the present invention comprises a tent cloth and a tent frame to support the tent cloth. The tent frame comprises a top module and a plurality of supporting poles which are radially pivoted to the top module. The top module comprises a modular main body, a top cap and a quick-pitch assembly. The modular main body comprises a plurality of pivot sockets which are integrally formed with the modular main body. Each pivot socket is pivotally connected with a connector. The connector is further connected to the respective supporting pole. The connector has a top engaging portion at a pivot end thereof to mate with the quick-pitch assembly. The top cap is coupled to the modular main body to form a middle space. The quick-pitch assembly is located in the middle space and able to move up and down.

Preferably, the quick-pitch assembly comprises an engaging pin, a pull rod and a spring. The engaging pin and the spring are located in the middle space defined between the top cap and the modular main body. The spring has one end acting on the engaging pin and the other end acting on the top cap. The pull rod has one end inserted through a through hole of the top cap and the spring and connected to the engaging pin. The other end of the pull rod is extended out of the through hole of the top cap.

Preferably, the connector is integrally formed with one end of the respective supporting rod.

Preferably, the top engaging portion has a protruding curve portion and a straight portion.

Preferably, the pull rod has a threaded portion.

Preferably, the engaging pin has an inner threaded portion.

Preferably, the upper end of the pull rod is provided with a pull ring.

Accordingly, the top module of the tent of the present invention is provided with the quick-pitch assembly to position the supporting poles stably after the supporting poles are unfolded and to fold the supporting poles quickly. The entire structure is simple and the installation and replacement of each part is quick to lower the manufacture cost greatly. When folding or unfolding the tent, the tent cloth won't be torn due to the pull force between the supporting poles and the tent cloth. The service life of the tent of the present invention can be prolonged.

DETAILED DESCRIPTION OF THE PREFERRED EMBODIMENTS

Embodiments of the present invention will now be described, by way of example only, with reference to the accompanying drawings.

Figure 1:
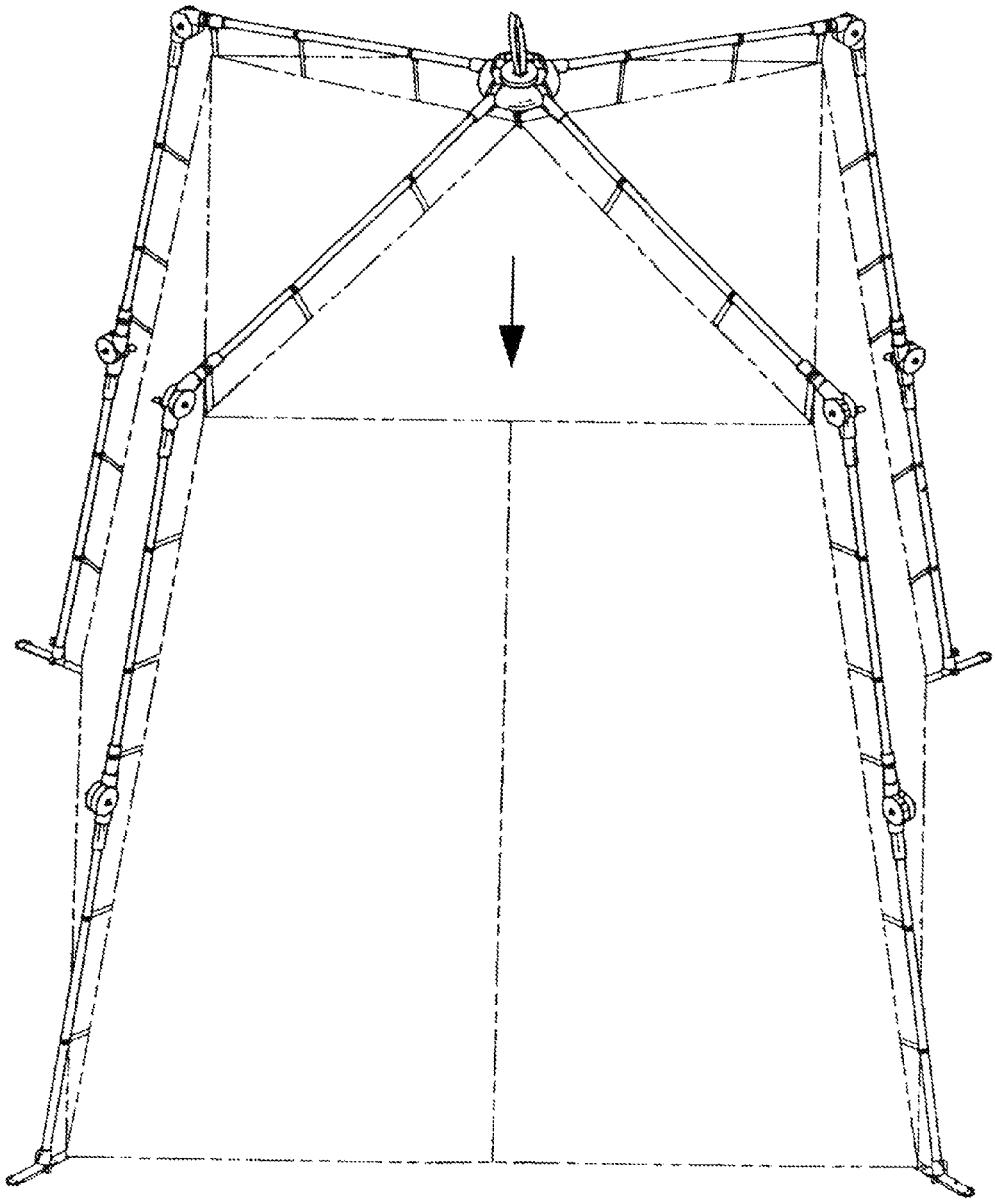
FIG. 1 Prior Art
FIG. 1 is a perspective view of a conventional tent frame.
Figure 2:
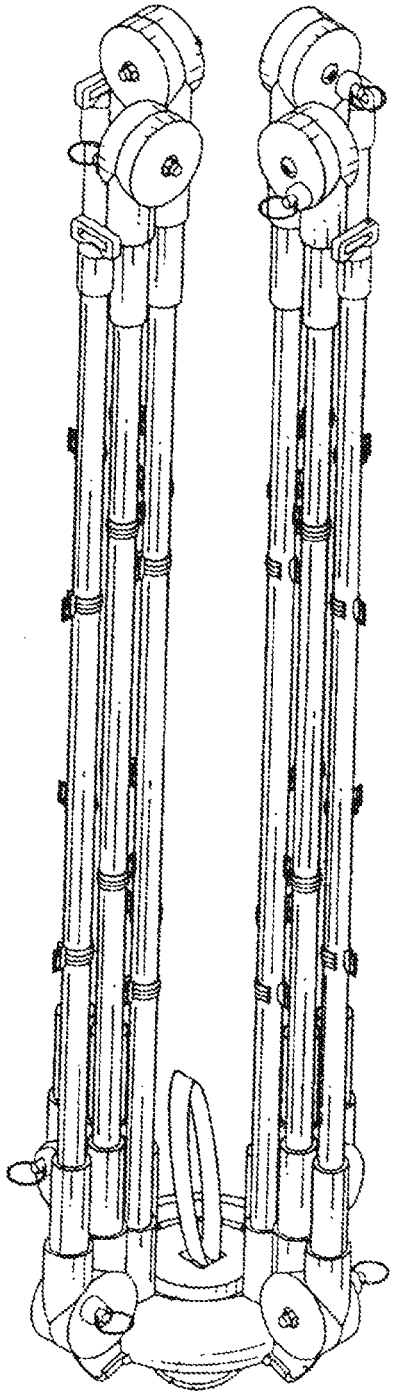
FIG. 2 is a perspective view of the conventional tent frame in a folded state.
Figure 3:
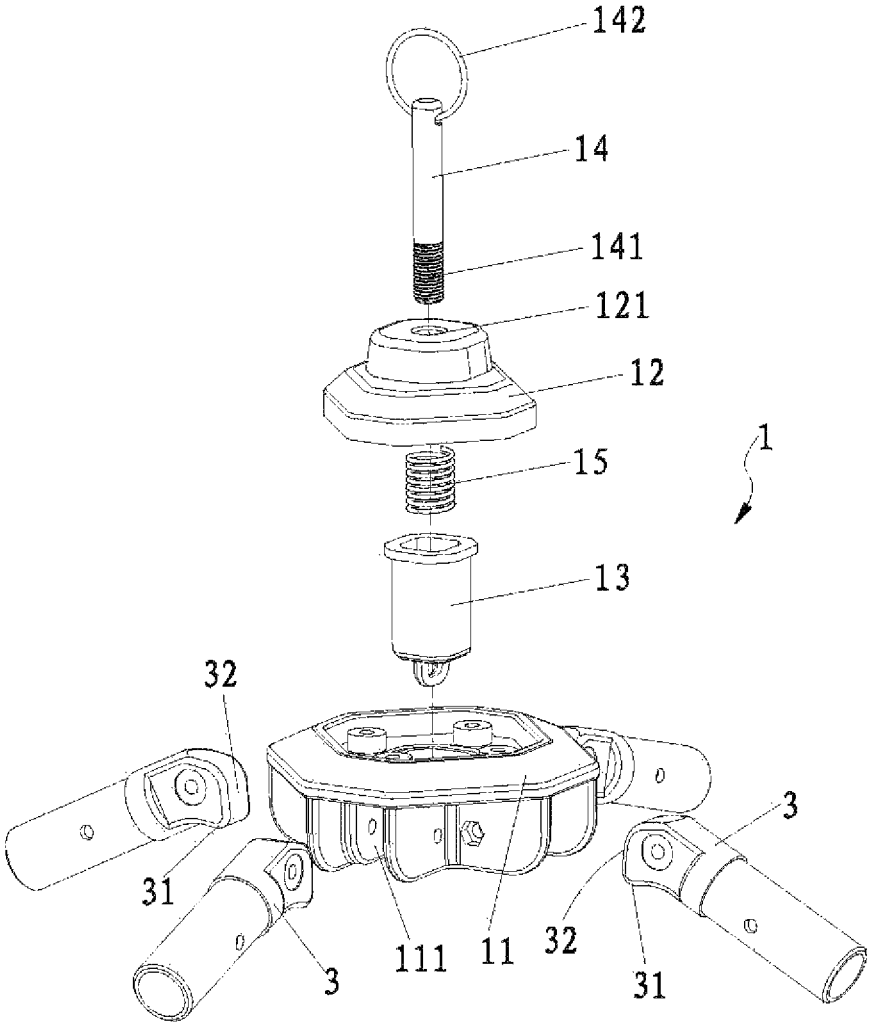
FIG. 3 is an exploded view according to a preferred embodiment of the present invention.
Figure 4:
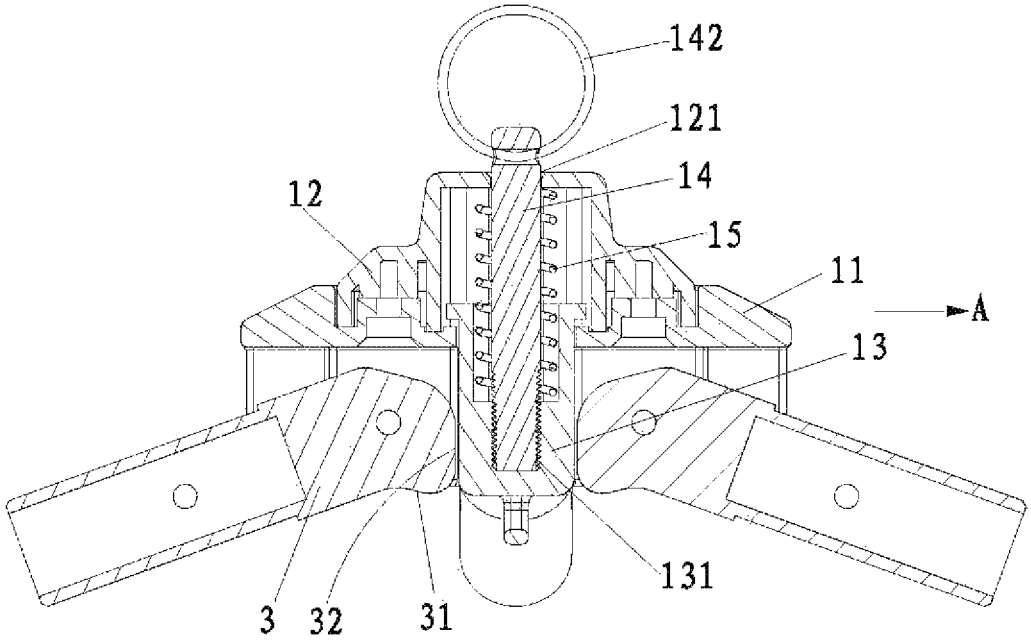
FIG. 4 is a sectional view showing the supporting poles in an unfolded state according to the preferred embodiment of the present invention.
Figure 6:
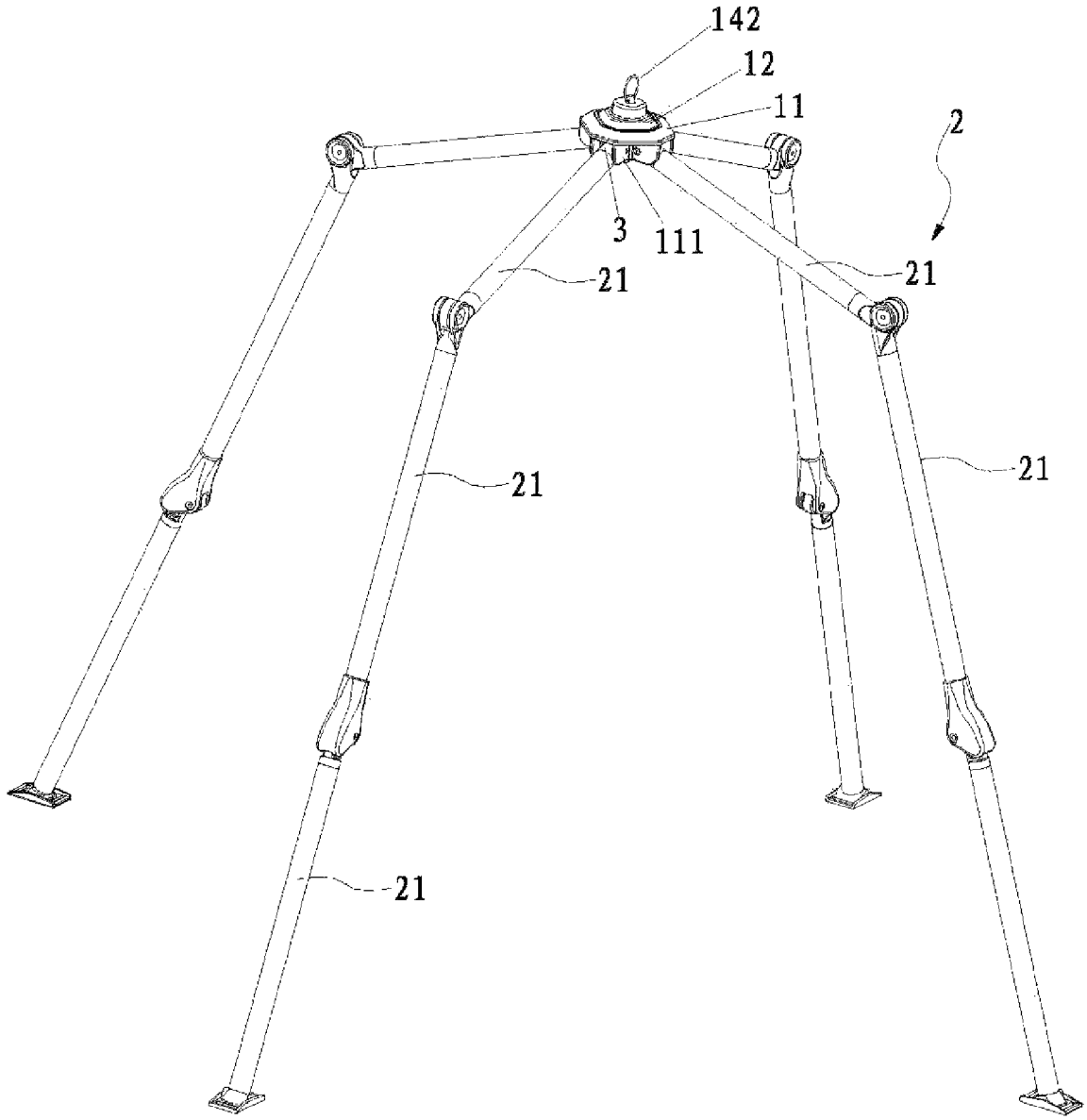
FIG. 6 is a schematic view showing the supporting poles according to the preferred embodiment of the present invention.

As shown in FIG. 3, FIG. 4 and FIG. 6, the tent of the present invention comprises a tent cloth and a tent frame to support the tent cloth. The tent frame comprises a top module 1 and a plurality of supporting poles 2 which are radially pivoted to the top module 1. Each supporting pole 2 is composed of a plurality of poles 21 which are pivotally connected. In general, each supporting pole 2 is composed of three poles 21. The tent cloth is fixed to the tent frame through a plurality of fixing sleeves (not shown in the drawings). The top module 1 comprises a modular main body 11, a top cap 12, and a quick-pitch assembly 13. The modular main body 11 comprises a plurality of pivot sockets 111 which are integrally formed with the modular main body 11. Each pivot socket 11 is pivotally connected with a connector 3. The connector 3 is further connected to the upper pole 21 of the respective supporting pole 2. As shown in FIG. 6, the connector 3 may be integrally formed with one end of the upper pole 21. The connector 3 is rotatable relative to the pivot socket 111. The connector 3 has a top engaging portion at a pivot end thereof to mate with the quick-pitch assembly 13. The top engaging portion has a protruding curve portion 31 and a straight portion 32 to confine the rotation angle of the connector 3 relative to the pivot socket 111, namely, to limit the expanding range of the supporting poles 2. The top cap 12 is coupled to the modular main body 11 to form a middle space.

The quick-pitch assembly comprises an engaging pin 13, a pull rod 14, and a spring 15. The engaging pin 13 and the spring 15 are located in the middle space. The spring 15 has one end acting on the engaging pin 13 and another end acting on the top cap 12. The engaging pin 13 has an inner threaded portion 131. The top cap 12 has a through hole 121. The pull rod 14 has a threaded portion 141 at one end thereof. The pull rod 14 is inserted through the through hole 121 of the top cap 12 and the spring 15, and the threaded portion 141 is screwed to the inner threaded portion 131 of the engaging pin 13. The other end of the pull rod 14 is extended out of the through hole 121 of the top cap 12. The pull rod 14 brings the engaging pin 13 to compress the spring 15 and to vertically move in the middle space. In order to operate the pull rod 14 conveniently, the upper end of the pull rod 14 is provided with a pull ring 142.

Figure 5:
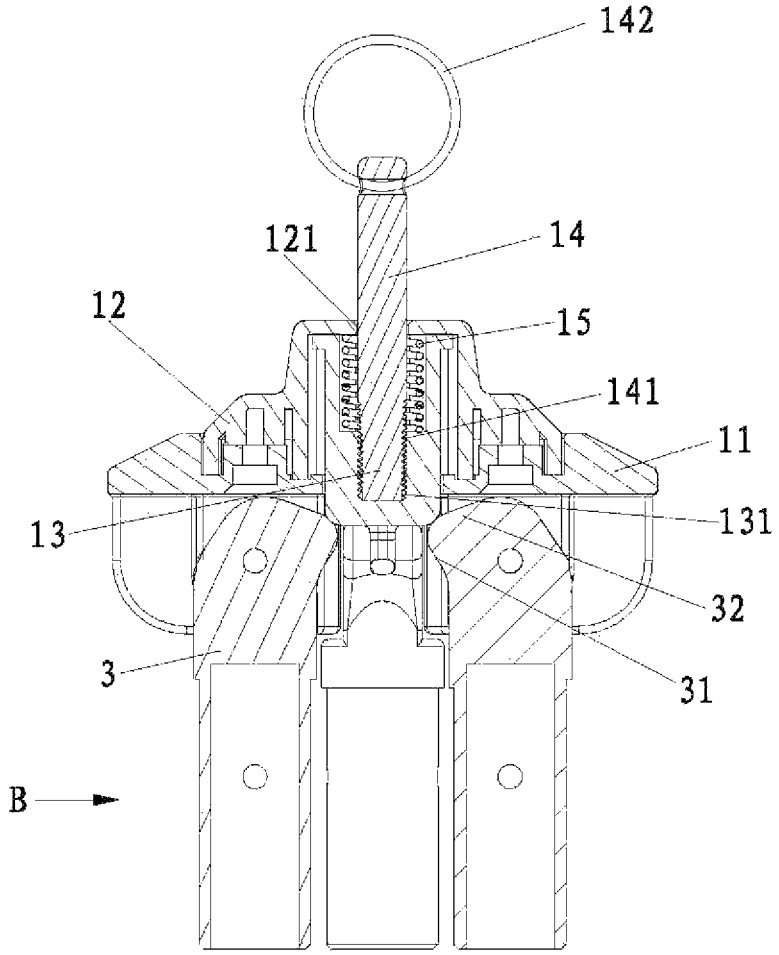
FIG. 5 is a sectional view showing the supporting poles in a folded state according to the preferred embodiment of the present invention.
Figure 8:
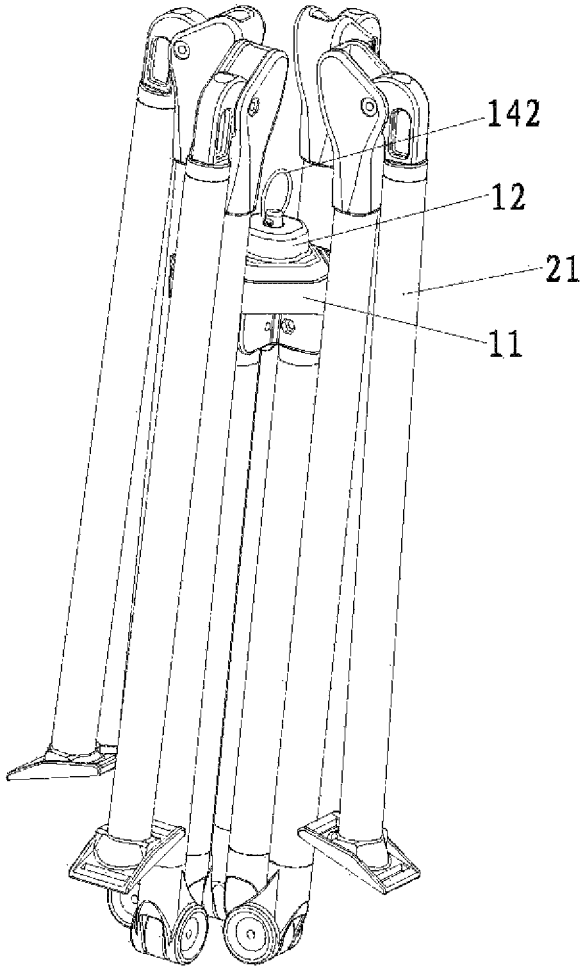
FIG. 8 is a schematic view showing the supporting poles in a folded state according to the preferred embodiment of the present invention.

To unfold the tent of the present invention, the upper poles 21 of the supporting poles 2 are unfolded outward in the direction indicated by the arrow A in FIG. 4. to bring the connectors 3 to turn relative to the pivot sockets 11. The curve portion 31 of the top engaging portion of the connector 3 gradually disengages from the engaging pin 13, such that the engaging pin 13 is vertically moved downward by its weight and the elastic force of the spring 15 until the straight portion 32 of the connector 3 engages with the outer surface of the engaging pin 13 to limit the utmost rotation angle of the connector 3. The supporting poles 2 are positioned stably after they are unfolded. When the tent is folded, the pull rod 14 is pulled upward to bring the engaging pin 13 to move upward and to compress the spring 15. The supporting poles 2 bring the connectors 3 to fold inward by the action of weight. As indicated by the arrow B in FIG. 5, the curve portion 31 of the top engaging portion of the connector 3 is located under the engaging pin 13. The engaging pin 13 compresses the spring 15 to keep an elastic state for the next use to unfold the tent. FIG. 8 shows the folded state of the tent.

Accordingly, the top module of the tent of the present invention is provided with the quick-pitch assembly to position the supporting poles stably after the supporting poles are unfolded and to fold the supporting poles quickly. The entire structure is simple and the installation and replacement of each part is quick to lower the manufacture cost greatly. When folding or unfolding the tent, the tent cloth won't be torn due to the pull force between the supporting poles and the tent cloth. The service life of the tent of the present invention can be prolonged.

Figure 7:
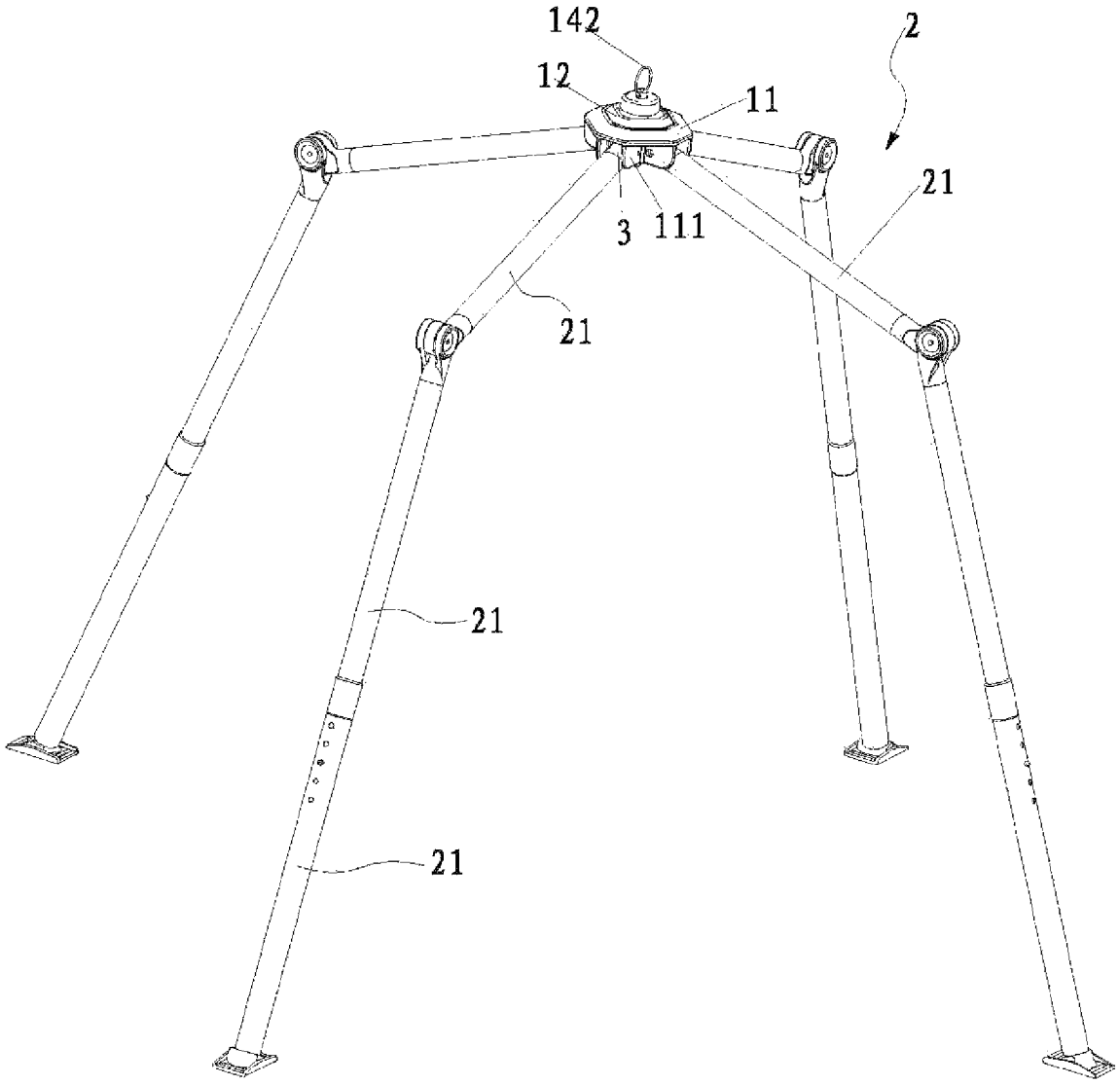
FIG. 7 is another schematic view showing the supporting poles according to the preferred embodiment of the present invention.

In addition, the supporting pole 2 is connected to the top module 1 through the connector 3, and is composed of a plurality of poles 21 which are pivotally connected. The poles 21 are connected through a movable joint, which can be folded as shown in FIG. 6. The structure of the joint is prior art and won't be described hereinafter. Alternatively, as shown in FIG. 7, the lower poles 21 of each supporting pole 2 can be retractable with each other. The lower poles are pivotally connected through a pivot joint. When folding the tent, the lower poles are first folded or retracted to lower the height of the tent. After that, the pull rod 4 is operated to fold the upper poles of the supporting poles. FIG. 8 shows the folded tent.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A tent comprising a tent cloth and a tent frame to support the tent cloth, the tent frame comprising a top module and a plurality of supporting poles which are radially pivoted to the top module, and characterized in that the top module comprising a modular main body, a top cap and a quick-pitch assembly;

the modular main body comprising a plurality of pivot sockets which are integrally formed with the modular main body, each pivot socket being pivotally connected with a connector, the connector being further connected to the respective supporting pole, the connector having a top engaging portion at a pivot end thereof to mate with the quick-pitch assembly, the top cap being coupled to the modular main body to form a middle space, the quick-pitch assembly being located in the middle space and able to move up and down.

2. The tent as claimed in claim 1, wherein the quick-pitch assembly comprises an engaging pin, a pull rod and a spring, the engaging pin and the spring being located in is the middle space defined between the top cap and the modular main body, the spring having one end acting on the engaging pin and another end acting on the top cap, the pull rod having one end inserted through a through hole of the top cap and the spring and connected to the engaging pin, another end of the pull rod being extended out of the through hole of the top cap.

3. The tent as claimed in claim 1, wherein the connector is integrally formed with one end of the respective supporting rod.

4. The tent as claimed in claim 1, wherein the top engaging portion has a protruding curve portion and a straight portion.

5. The tent as claimed in claim 2, wherein the pull rod has a threaded portion.

6. The tent as claimed in claim 2, wherein the engaging pin has an inner threaded portion.

7. The tent as claimed in claim 2, wherein an upper end of the pull rod is provided with a pull ring.

* * * * *